US012104138B2

(12) United States Patent
Hamashima

(10) Patent No.: US 12,104,138 B2
(45) Date of Patent: Oct. 1, 2024

(54) LUBRICANT COMPOSITION FOR PLASTIC WORKING

(71) Applicant: MORESCO CORPORATION, Hyogo (JP)

(72) Inventor: Kentaro Hamashima, Hyogo (JP)

( * ) Notice: Subject to any disclaimer, the term of this patent is extended or adjusted under 35 U.S.C. 154(b) by 0 days.

(21) Appl. No.: 17/925,118

(22) PCT Filed: Apr. 21, 2021

(86) PCT No.: PCT/JP2021/016113

§ 371 (c)(1),
(2) Date: Nov. 14, 2022

(87) PCT Pub. No.: WO2021/230023

PCT Pub. Date: Nov. 18, 2021

(65) Prior Publication Data

US 2023/0183598 A1 Jun. 15, 2023

(30) Foreign Application Priority Data

May 15, 2020 (JP) ..... 2020-086055

(51) Int. Cl.

| | |
|---|---|
| ***C10M 173/02*** | (2006.01) |
| ***C10M 129/52*** | (2006.01) |
| ***C10M 145/14*** | (2006.01) |
| ***C10M 145/40*** | (2006.01) |
| *C10N 10/02* | (2006.01) |
| *C10N 20/06* | (2006.01) |
| *C10N 40/20* | (2006.01) |
| *C10N 50/00* | (2006.01) |

(52) U.S. Cl.

CPC ..... *C10M 173/02* (2013.01); *C10M 129/52* (2013.01); *C10M 145/14* (2013.01); *C10M 145/40* (2013.01); *C10M 2207/142* (2013.01); *C10M 2209/084* (2013.01); *C10M 2209/12* (2013.01); *C10N 2010/02* (2013.01); *C10N 2020/06* (2013.01); *C10N 2040/242* (2020.05); *C10N 2040/246* (2020.05); *C10N 2040/247* (2020.05); *C10N 2050/01* (2020.05)

(58) Field of Classification Search

CPC ..... C10M 173/02; C10M 129/52; C10M 145/14; C10M 145/40; C10M 2207/142; C10M 2209/084; C10M 2209/12; C10N 2040/246; C10N 2040/247; C10N 2040/242; C10N 2050/01; C10N 2010/02; C10N 2020/06

See application file for complete search history.

(56) References Cited

U.S. PATENT DOCUMENTS

| | | | | |
|---|---|---|---|---|
| 5,348,672 | A | 9/1994 | Ohkura et al. | |
| 2008/0194441 | A1* | 8/2008 | Kawata | C10M 169/00 508/296 |
| 2016/0160150 | A1* | 6/2016 | Mochizuki | C10M 137/04 427/372.2 |
| 2017/0275549 | A1 | 9/2017 | Hamashima | |
| 2020/0277539 | A1* | 9/2020 | Hamashima | C10M 173/02 |

FOREIGN PATENT DOCUMENTS

| | | |
|---|---|---|
| JP | 05-125384 | 5/1993 |
| JP | 05-279689 | 10/1993 |
| JP | 2004/307570 A | 11/2004 |
| JP | 5906559 | 4/2016 |

OTHER PUBLICATIONS

Office Action for CN Patent Application No. 202180034006.9, dated Feb. 23, 2023, 3 pages.
Written Opinion for PCT/JP2021/016113 and its English translation, dated Jul. 13, 2021, 6 pages.
International Search Report for PCT/JP2021/016113 and its English Translation, dated Jul. 13, 2021.

* cited by examiner

*Primary Examiner* — Vishal V Vasisth
(74) *Attorney, Agent, or Firm* — Casimir Jones, S.C.; Robert A. Goetz

(57) ABSTRACT

Provided is a lubricant composition for plastic working of a ferrous material, the lubricant composition being excellent in lubricity and releasability and not staining the work environment black. A lubricant composition for plastic working of a ferrous material is used, the lubricant composition containing (a) an alkali metal salt of an organic acid, (b) water-based resin particles, (c) a water-soluble polymer, and (d) water, the (b) water-based resin particles including particles having a particle diameter of not more than 0.1 μm in an amount of more than 5% by weight relative to a total amount of the (b) water-based resin particles.

6 Claims, No Drawings

LUBRICANT COMPOSITION FOR PLASTIC WORKING

This application is a 371 of PCT/JP2021/016113 filed Apr. 21, 2021.

TECHNICAL FIELD

The present invention relates to a lubricant composition for plastic working of a ferrous material.

BACKGROUND ART

Generally, when a material that is to be worked and that is a ferrous material such as carbon steel, alloy steel, stainless steel, spring steel, and bearing steel is subjected to plastic working using a die, such as forging, rolling, wire drawing, and extrusion, in a temperature range for warm working or a temperature range for hot working, a lubricant is used to improve lubricity and releasability between the die and the material to be worked.

Conventionally used as such a lubricant are graphite-based lubricants for plastic working, which contain graphite dispersed in oil or water. Graphite-based lubricants for plastic working are excellent in lubricity and releasability, but disadvantageously stains the working environment black due to containing graphite.

As such, there is a demand in recent years for development of a graphite-free lubricant for plastic working, i.e., a non-graphite-based lubricant for plastic working that is comparable in performance to graphite-based lubricant compositions for plastic working.

Such a non-graphite-based lubricant for plastic working is indicated in Patent Literature 1, which discloses a water-soluble lubricant for hot plastic working, containing (a) 0.1% by weight to 30% by weight of resin powder having an average particle diameter in a range of 0.1 μm to 10 μm and having a particle size distribution such that particles having a particle diameter of not more than 0.1 μm are present in an amount of not more than 5% by weight and particles having a particle diameter of not less than 10 μm are present in an amount of not more than 5% by weight, (b) 0.1% by weight to 30% by weight of alkali metal salts of isophthalic acid and adipic acid, and (c) 0.1 by weight to 10% by weight of a water-soluble polymer compound, with the remainder consisting of water.

Further, Patent Literature 2 discloses a lubricant for warm forging and hot forging, containing: at least wax out of wax and carboxylate; and water, and not containing inorganic powder for lubrication.

CITATION LIST

Patent Literature

[Patent Literature 1]
Japanese Patent Application Publication, Tokukaihei, No. 5-279689
[Patent Literature 2]
Japanese Patent Application Publication, Tokukaihei, No. 5-125384

SUMMARY OF INVENTION

Technical Problem

However, the non-graphite-based lubricants for plastic working as described above have room for further improvement from the perspective of providing a lubricant for plastic working that is comparable in lubricity and releasability to graphite-based lubricants for plastic working.

As such, an aspect of the present invention has an object to provide a non-graphite-based lubricant composition for plastic working that is excellent in lubricity and releasability.

Solution to Problem

As a result of conducting diligent research in order to solve the foregoing problem, the inventors of the present invention discovered that a non-graphite-based lubricant composition for plastic working of a ferrous material, the non-graphite-based lubricant composition being excellent in lubricity and releasability, can be provided by using a lubricant composition for plastic working containing (a) an alkali metal salt of an organic acid, (b) water-based resin particles, (c) a water-soluble polymer, and (d) water, wherein the (b) water-based resin particles include a predetermined amount of particles having a particle diameter of not more than 0.1 μm, and a mixing ratio of (a) and (b) is in a predetermined range. On the basis of this finding, the inventors completed the present invention.

Specifically, a lubricant composition for plastic working in accordance with an embodiment of the present invention is a lubricant composition for plastic working of a ferrous material, containing (a) an alkali metal salt of an organic acid, (b) water-based resin particles, (c) a water-soluble polymer, and (d) water, wherein a weight ratio of the (b) water-based resin particles to the (a) alkali metal salt of the organic acid, represented as a weight of the (b) water-based resin particles/a weight of the (a) alkali metal salt of the organic acid, is less than 10, and the (b) water-based resin particles include particles having a particle diameter of not more than 0.1 μm in an amount of more than 5% by weight relative to a total amount of the (b) water-based resin particles.

Advantageous Effects of Invention

An aspect of the present invention makes it possible to provide a lubricant composition for plastic working that is excellent in lubricity and releasability and not staining the work environment black.

DESCRIPTION OF EMBODIMENTS

The following description will discuss embodiments of the present invention in detail. Note, however, that the present invention is not limited to the following embodiments, but can be altered within this disclosure. The present invention also encompasses, in its technical scope, any embodiment derived by combining technical means disclosed in differing embodiments. Note that the expression "A to B", representing a numerical range, herein means "not less than A and not more than B" unless otherwise specified in this specification.

[1. Lubricant Composition for Plastic Working]

A lubricant composition for plastic working in accordance with an embodiment of the present invention is a lubricant composition for plastic working of a ferrous material, containing (a) an alkali metal salt of an organic acid, (b) water-based resin particles, (c) a water-soluble polymer, and (d) water, wherein the (b) water-based resin particles include particles having a particle diameter of not more than 0.1 μm in an amount of more than 5% by weight relative to a total amount of the (b) water-based resin particles.

In the present specification, "lubricant composition for plastic working" means a composition that can be used as a lubricant in plastic working of a material to be worked. The material to be worked is not limited to any particular one, provided that the material is a ferrous material that can be subjected to plastic working. The ferrous material refers to a material that contains iron as a main component in an amount of preferably not less than 50% by weight, more preferably not less than 70% by weight, and even more preferably not less than 80% by weight. Examples of such a ferrous material that is suitable for use in plastic working include carbon steel, alloy steel (chromium steel, chromium-molybdenum steel, manganese steel, manganese-boron steel, nickel-chromium-molybdenum steel, chromium-vanadium steel, and the like), stainless steel, spring steel, and bearing steel. Plastic working is preferably carried out in a temperature range for warm working or a temperature range for hot working. Examples of plastic working include, but are not limited to, forging, extrusion, rolling, pressing, wire drawing, and rotational forming such as spinning. A lubricant composition for plastic working (may hereinafter be referred to simply as "lubricant composition") in accordance with an embodiment of the present invention can be effectively used as, in particular, a lubricating release agent for warm forging and hot forging. In using a lubricant composition in accordance with an embodiment of the present invention as a lubricating release agent for warm forging and hot forging, the lubricant composition can be used in a similar manner to a conventionally known lubricating release agent for warm forging and hot forging. The temperature range for warm working and the temperature range for hot working are each 200° C. to 1250° C., and preferably each 600° C. to 1250° C.

In the present specification, the expression "excellent in lubricity" means that, in a case where a lubricant composition is used when a material to be worked is worked with use of a die, friction between the die and the material to be worked can be reduced. This makes it possible to reduce abrasion of the die and further to obtain a good plastically worked product. Lubricity can be evaluated, for example, by comparison between lengths of lateral elongation in a ring compression test described in Examples. Note that lateral elongation means elongation in a direction perpendicular to a pressing direction. Use of a lubricant composition having excellent lubricity as evaluated by a ring compression test makes it possible, for example, in forging, to obtain a forged product exhibiting longer lateral elongation than a forged product obtained with use of a lubricant composition having inferior lubricity. Alternatively, lubricity can be evaluated by comparison between lengths of axial elongation in a spike test described in Examples. Use of a lubricant composition having excellent lubricity as evaluated by a spike test makes it possible, for example, in forging, to obtain a forged product exhibiting longer axial elongation than a forged product obtained with use of a lubricant composition having inferior lubricity.

In the present specification, the expression "excellent in releasability" means that, in a case where a lubricant composition is used when a material to be worked is worked with use of a die, the material which has been worked is released from the die without occurrence of seizure between the material which has been worked and the die. Further, releasability can be evaluated, for example, by checking the presence or absence of seizure of the material which has been worked in a spike test described in Examples.

[(a) Alkali Metal Salt of Organic Acid]

A lubricant composition in accordance with an embodiment of the present invention contains an alkali metal salt of an organic acid. Due to containing the alkali metal salt of the organic acid, the lubricant composition in accordance with an embodiment of the present invention has improved lubricity.

Examples of the organic acid of the alkali metal salt of the organic acid include, but are not limited to, saturated carboxylic acids such as oxalic acid, malonic acid, succinic acid, malic acid, citric acid, adipic acid, azelaic acid, sebacic acid, dodecanedioic acid, 1,2-cyclohexanedicarboxylic acid, and hexahydrophthalic anhydride; unsaturated carboxylic acids such as fumaric acid, maleic acid, itaconic acid, 1,2,3,6-tetrahydrophthalic anhydride, 4-cyclohexene-1,2-dicarboxylic acid, 1-cyclohexene-1,2-dicarboxylic acid, and cyclohexene-1,2-dicarboxylic anhydride; aromatic carboxylic acids such as benzoic acid, salicylic acid, phthalic anhydride, phthalic acid, isophthalic acid, terephthalic acid, trimellitic acid, and naphthalenedicarboxylic acid. Examples of the alkali metal include sodium and potassium. The organic acid is, specifically, water-solubilized by, for example, causing the organic acid to form a salt with sodium hydroxide or potassium hydroxide to obtain an alkali metal salt. Further, any of such alkali metal salts of organic acids may be used alone, or two or more of them may be used in combination.

In an embodiment of the present invention, a content of an alkali metal salt of an organic acid is preferably 20% by weight to 95% by weight, more preferably 25% by weight to 95% by weight, and even more preferably 30% by weight to 90% by weight, relative to a total solid content in the lubricant composition for plastic working. It is considered that in a case where the content of the alkali metal salt of the organic acid is not less than 20% by weight relative to the total solid content in the lubricant composition for plastic working, a lubricating film has improved followability with respect to a material to be worked between the die and the material to be worked, so that the lubricating film is prevented from having a missing part between the die and the material to be worked. This is a phenomenon similar to cleavage of graphite-based lubricants, and is considered to provide excellent lubricity and releasability.

[(b) Water-Based Resin Particles]

A lubricant composition in accordance with an embodiment of the present invention contains water-based resin particles. Due to containing the water-based resin particles, the lubricant composition in accordance with an embodiment of the present invention has improved lubricity.

In an embodiment of the present invention, the water-based resin particles only need to be particles of a water-based resin. Examples of the water-based resin include an acrylic resin, a styrene-acrylic resin, a vinyl acetate-acrylic resin, a urethane resin, a urethane-acrylic resin, a silicone-acrylic resin, a polyester resin, a silicone-urethane resin, a polyolefin resin, a polyvinyl-based resin, a polyamide resin, polyimide resin, a natural polysaccharide, a polyvinyl acetate resin, a polyvinyl chloride resin, a polystyrene resin, a phenol resin, an epoxy resin, a phenoxy resin, a urea resin, a melamine resin, an alkyd resin, a formaldehyde resin, a silicone resin, a fluorine resin, a rosin-based resin, a petroleum resin, and a ketone-based resin. The water-based resin can also be a modified product, a mixture, or a copolymer of these resins. Any of such water-based resins may be used alone, or a plurality of them may be used in combination.

The water-based resin may be of a water-soluble type, or may be of a water-dispersible type such as a colloidal dispersion type or an emulsion type. The water-based resin particles of a water-soluble type or a colloidal dispersion type is obtained, for example, by adding, to a resin synthesized with use of a hydrophilic solvent, a neutralizer to dissolve or semi-dissolve the resin in water. The water-based resin particles of an emulsion type is obtained, for example, by emulsion polymerization or by mechanical, forced emulsification of a hydrophobic resin.

In an embodiment of the present invention, the water-based resin particles include particles having a particle diameter of not more than 0.1 μm in an amount of more than 5% by weight relative to a total amount of the water-based resin particles. It has been found that thus increasing a ratio of water-based resin particles each having a small particle diameter makes it possible to provide a lubricant composition which, for example, when applied by spraying or the like, can form a dense lubricating film on a die and is excellent in lubricity and releasability. Further, the composition having a high ratio of water-based resin particles having a small particle diameter also has excellent dispersibility, so that a ratio of water-based resin particles that are accumulated by sedimentation or clog a nozzle is decreased. This is considered to be a factor for prevention of deterioration of lubricity and releasability of the lubricant composition for plastic working.

The water-based resin particles more preferably include more than 5% by weight of particles having a particle diameter of not more than 0.1 μm and have an average particle diameter of 0.01 μm to 10 μm, even more preferably include more than 5% by weight of particles having a particle diameter of not more than 0.1 μm and have an average particle diameter of 0.02 μm to 5 μm, yet even more preferably include more than 5% by weight of particles having a particle diameter of not more than 0.1 μm and have an average particle diameter of 0.03 μm to 2 μm, and particularly preferably include more than 5% by weight of particles having a particle diameter of not more than 0.1 μm and have an average particle diameter of 0.05 μm to 1 μm.

Further, the water-based resin particles more preferably include particles having a particle diameter of not less than 10 μm in an amount of not more than 5% by weight relative to a total amount of the water-based resin particles, and even more preferably include particles having a particle diameter of not less than 1.0 μm in an amount of not more than 5% by weight relative to the total amount of the water-based resin particles.

An average particle diameter and/or a particle diameter distribution of the water-based resin particles are/is preferably within these ranges because in that case, the lubricity, releasability, and dispersibility of the lubricant composition for plastic working are improved.

In the present specification, a ratio of particles having a particle diameter of not more than 0.1 μm relative to a total amount of water-based resin particles and a ratio of particles having a particle diameter of not less than a predetermined size relative to the total amount of the water-based resin particles are each a ratio which is obtained from a particle size distribution obtained by measurement using a laser diffraction/scatter particle size distribution meter and which is specifically obtained from percentage values of cumulative frequency. In the present specification, "average particle diameter" means a median size (a median diameter, which is a particle diameter $D_{50}$ at which a cumulative frequency is 50%) obtained from the particle size distribution.

The acrylic resin is a general term for a polymer compound synthesized by a polymerization reaction (homopolymerization or copolymerization) of an acrylic acid ester monomer or a methacrylic acid ester monomer (hereinafter, acrylic acid ester monomers and methacrylic acid ester monomers may be referred to as acrylic monomers). The acrylic resin can be modified by copolymerization with another monomer, and the acrylic resin thus modified is also encompassed in the scope of acrylic resins in the present invention. Examples of the modified acrylic resin include a copolymer of an acrylic monomer and an addition monomer that is copolymerizable with the acrylic monomer.

Examples of the acrylic monomer include methyl acrylate, methyl methacrylate, ethyl acrylate, ethyl methacrylate, isopropyl methacrylate, n-butyl methacrylate, isobutyl methacrylate, n-hexyl methacrylate, 2-ethylhexyl acrylate, acrylic acid, methacrylic acid, 2-hydroxyethyl acrylate, hydroxypropyl acrylate, 2-hydroxyethyl methacrylate, hydroxypropyl methacrylate, glycidyl acrylate, glycidyl methacrylate, sulfoethyl acrylate, and polyethylene glycol methacrylate. Examples of the addition monomer copolymerizable with the acrylic monomer include styrene, vinyl acetate, silicone, maleic acid, itaconic acid, acrylamide, N-methylolacrylamide, diacetone acrylamide, acrylonitrile, and vinyl sulfonic acid.

Examples of the urethane resin include a polyurethane that is a urethane resin obtained by condensation polymerization between (i) a polyol such as a polyester polyol, a polyether polyol, or a polycarbonate polyol and (ii) an aliphatic polyisocyanate, an alicyclic isocyanate and/or an aromatic polyisocyanate compound and that is obtained with use of the polyol which has, in a portion thereof, a polyoxyethylene chain such as polyethylene glycol or polypropylene glycol.

Examples of the polyester resin include: a polyester polyol obtained by condensation of (i) a polybasic acid such as maleic acid, fumaric acid, itaconic acid, succinic acid, glutaric acid, suberic acid, adipic acid, azelaic acid, sebacic acid, dimer acid, trimer acid, isophthalic acid, terephthalic acid, trimellitic acid, trimesic acid, pyromellitic acid, or naphthalenedicarboxylic acid and (ii) a polyol such as ethylene glycol, diethylene glycol, trimethylolpropane, neopentyl glycol, 1,4-CHDM, or 1,6-hexanediol; and a condensation resin obtained by condensation of the polybasic acid and a polyol such as polymer polyol, polycaprolactone polyol, polycarbonate diol, polybutadiene polyol, neopentyl glycol, or methyl pentadiol.

Examples of the polyolefin resin include: polypropylene; polyethylene; a copolymer of propylene, ethylene, and α-olefin; a modified polyolefin obtained by modification of a polyolefin, such as, with use of an unsaturated carboxylic acid (e.g., acrylic acid or methacrylic acid); and a copolymer of ethylene and an acrylic acid (methacrylic acid). It is also possible to use any of these polyolefin resins further copolymerized with a small amount of another ethylenically unsaturated monomer. Examples of means for causing the polyolefin resin to be water based include neutralizing a carboxylic acid, which has been introduced into the polyolefin resin, with use of ammonia and/or an amine.

Any of the various water-based resin particles described above may be used alone, or two or more of them may be used in combination.

In an embodiment of the present invention, a content of water-based resin particles is preferably 0.5% by weight to 50% by weight, more preferably 1.0% by weight to 45% by weight, and even more preferably 1.5% by weight to 40% by weight, relative to a total solid content in the lubricant composition for plastic working. In a case where the content of the water-based resin particles is not less than 0.5% by weight relative to the total solid content in the lubricant composition for plastic working, excellent lubricity, releasability, and dispersibility are achieved.

In an embodiment of the present invention, a weight ratio of the water-based resin particles to the alkali metal salt of the organic acid, represented as a weight of the (b) water-based resin particles/a weight of the (a) alkali metal salt of the organic acid, is preferably less than 10. The weight ratio is preferably less than 10 because in that case, a lubricant composition having excellent lubricity is obtained. The weight ratio is more preferably not more than 5, even more preferably not more than 3, even more preferably not more than 2, and even more preferably not more than 1.

In an embodiment of the present invention, a content of the water-based resin particles relative to the lubricant composition is not particularly limited, provided that it is more than 0. However, the content is more preferably not less than 0.5% by weight. The content of the water-based resin particles is preferably not less than 0.5% by weight because in that case, a lubricant composition having even more excellent lubricity is obtained.

In an embodiment of the present invention, a weight ratio of the water-based resin particles to the alkali metal salt of the organic acid, represented as a weight of the (b) water-based resin particles/a weight of the (a) alkali metal salt of the organic acid, is not particularly limited, provided that it is more than 0. It is preferable, however, that the weight ratio be not less than 0.02. The weight ratio is preferably not less than 0.02 because in that case, a lubricant composition having even more excellent lubricity is obtained.

[(c) Water-Soluble Polymer]

A lubricant composition in accordance with an embodiment of the present invention contains a water-soluble polymer. Due to containing the water-soluble polymer, the lubricant composition in accordance with an embodiment of the present invention can be sufficiently applied to a surface of a die having a high temperature, and thus exhibits lubricity and releasability.

A water-soluble polymer used in an embodiment of the present invention has viscosity that is increased when the water-soluble polymer is dissolved in water. This enables an improvement in dispersibility of the water-based resin particles. Further, the increase in viscosity allows the water-soluble polymer to function as a binder component in a case where the lubricant composition is applied by spraying onto a die having a high temperature. This is considered to enable an improvement in efficiency of adherence of the (a) alkali metal salt of the organic acid and an improvement in efficiency of adherence of the (b) water-based resin particles. It is thus possible to obtain a lubricant composition that is excellent in adherence and forms a homogeneous, strong, hard lubricating film exhibiting heat resistance even in a harsh environment of warm plastic working or hot plastic working.

In the present specification, the expression "excellent in adherence" means that a lubricating film, which not only exhibits improved adherence efficiencies of components but also adheres firmly to a surface of a die, is formed when a lubricant composition is applied onto the surface of the die.

Examples of the water-soluble polymer include a cellulose derivative, an alkali metal salt of a polymaleic acid-based resin, and an alkali metal salt of polyacrylic acid. Any of such water-soluble polymers may be used alone, or two or more of them may be used in combination.

Examples of the cellulose derivative include, but are not limited to, hydroxyethyl cellulose, carboxymethylcellulose sodium salt, and hydroxymethylcellulose sodium salt. Further, any of such cellulose derivatives may be used alone, or two or more of them may be used in combination. The cellulose derivative has a weight average molecular weight of 10,000 to 10,000,000, more preferably 50,000 to 5,000,000, and even more preferably 100,000 to 2,000,000.

Examples of the polymaleic acid-based resin include, but are not limited to, polymers such as a copolymer of isobutylene and maleic anhydride, a copolymer of styrene and maleic anhydride, a copolymer of methylvinyl ether and maleic anhydride, and a copolymer of α-methylstyrene and maleic anhydride. A polymer obtained by modification of any of such polymers with use of an imide or with use of an ammonia is encompassed in the scope of the polymaleic acid-based resin. Examples of the alkali metal include sodium and potassium. The polymaleic acid-based resin, specifically, is water-solubilized by, for example, forming a salt with sodium hydroxide or potassium hydroxide to yield an alkali metal salt. Further, any of such alkali metal salts of polymaleic acid-based resins may be used alone, or two or more of them may be used in combination.

Examples of an alkali metal salt of polyacrylic acid include, but are not limited to, sodium polyacrylate and potassium polyacrylate. These alkali metal salts may be conventionally known, commercially available alkali metal salts. The alkali metal salt has a weight average molecular weight of 1,000 to 5,000,000, more preferably 2,000 to 3,000,000, and even more preferably 3,000 to 1,000,000.

In an embodiment of the present invention, a content of a water-soluble polymer is preferably 0.5% by weight to 20% by weight, more preferably 0.7% by weight to 17% by weight, and even more preferably 1.0% by weight to 15% by weight, relative to a total solid content in the lubricant composition for plastic working. In a case where the content of the water-soluble polymer is 0.5% by weight to 20% by weight relative to the total solid content in the lubricant composition for plastic working, improved lubricity is achieved when the lubricant composition in accordance with an embodiment of the present invention is applied onto a surface of a die. Further, it is possible to form a lubricating film, which not only exhibits improved adherence efficiencies of components but also adheres firmly to the surface of the die.

[(d) Water]

A lubricant composition in accordance with an embodiment of the present invention contains water. The water is not limited to any particular one, provided that the water allows components to be uniformly dissolved or dispersed. It is preferable, however, that the water be purified water such as ion exchange water or pure water.

In an embodiment of the present invention, a content of the water is preferably a remainder obtained by subtracting contents of respective components from 100% by weight of the lubricant composition for plastic working.

In an embodiment of the present invention, a content of water may be adjusted as appropriate in accordance with components used, an amount applied onto a die, and the like, and is not particularly limited. For example, the content of water is preferably 50% by weight to 95% by weight, and more preferably 60% by weight to 95% by weight, relative to a total amount of the lubricant composition for plastic working.

[Other Components]

A lubricant composition in accordance with an embodiment of the present invention only needs to contain (a) an alkali metal salt of an organic acid, (b) water-based resin particles, (c) a water-soluble polymer, and (d) water, but may contain any other component(s) provided that there is no adverse effect on the advantageous effect of the present invention.

Examples of the any other component(s) include an inorganic acid salt, inorganic powder, a dispersing agent, an extreme pressure additive, a metal corrosion inhibitor, a preservative, and an antifoaming agent. In particular, inorganic acid salt and inorganic powder, each of which has high heat resistance, reduce metal-to-metal contact between a die and a material to be worked, and thus are expected to further improve the lubricity and the releasability.

It is therefore preferable that a lubricant composition in accordance with an embodiment of the present invention further contain, in addition to (a) an alkali metal salt of an organic acid, (b) water-based resin particles, (c) a water-soluble polymer, and (d) water, at least one selected from (e) an inorganic acid salt and (f) inorganic powder.

The inorganic acid salt is not limited to any particular one. Examples of the inorganic acid salt include an alkali metal salt of an inorganic acid, an alkaline earth metal salt of an inorganic acid, an aluminum salt of an inorganic acid, and an ammonium salt of an inorganic acid. More specific examples of the inorganic acid salt include: chlorides such as sodium chloride, potassium chloride, and magnesium chloride; sulfates such as sodium sulfate, potassium sulfate, magnesium sulfate, and aluminum sulfate; nitrates such as sodium nitrate and potassium nitrate; borates such as sodium borate, potassium borate, and ammonium borate; carbonates such as sodium carbonate, potassium carbonate, sodium hydrogen carbonate, and potassium hydrogen carbonate; silicates such as sodium silicate and potassium silicate; phosphates such as sodium dihydrogen phosphate, disodium hydrogen phosphate, trisodium phosphate, sodium pyrophosphate, sodium tripolyphosphate, sodium tetrapolyphosphate, sodium pentapolyphosphate, sodium hexametaphosphate, and calcium phosphate; molybdates such as ammonium molybdate and sodium molybdate; and tungstates such as sodium tungstate. Any of such inorganic acid salts may be used alone, or two or more of them may be used in combination.

Examples of the inorganic powder include calcium carbonate, calcium hydroxide, calcium stearate, aluminum hydroxide, synthetic mica, natural mica, sepiolite, kaolin, silica, talc, boron nitride, barium sulfate, bentonite, melamine cyanurate, alumina, sericite, vermiculite, and hydrotalcite. Any of such inorganic powders may be used alone, or two or more of them may be used in combination.

In an embodiment of the present invention, in a case where a lubricant composition contains an inorganic acid salt, a content of the inorganic acid salt is preferably 0.1% by weight to 25% by weight, and more preferably 0.5% by weight to 20% by weight, relative to a total solid content in the lubricant composition for plastic working.

In an embodiment of the present invention, in a case where a lubricant composition contains inorganic powder, a content of the inorganic powder is preferably 0.05% by weight to 15% by weight, and more preferably 0.1% by weight to 10% by weight, relative to a total solid content in the lubricant composition for plastic working.

In an embodiment of the present invention, a total content of the any other component(s) excluding the inorganic acid salt and the inorganic powder is not particularly limited, provided that there is no adverse effect on the effect of the present invention. It is preferable, however, that the total content be not more than 20% by weight relative to a total solid content in the lubricant composition for plastic working.

[2. Method for Producing Lubricant Composition for Plastic Working and Method of Using Lubricant Composition for Plastic Working]

A method for producing a lubricant composition for plastic working in accordance with an embodiment of the present invention is not particularly limited. The lubricant composition is produced by mixing the components described above including (a) an alkali metal salt of an organic acid, (b) water-based resin particles, (c) a water-soluble polymer, and (d) water.

The order of mixing the components is also not particularly limited, but (a) the alkali metal salt of the organic acid, (b) the water-based resin particles, (c) the water-soluble polymer, and (d) the water can be mixed, for example, in the following order. In a preferable example, for example, the alkali metal salt is added to water to obtain a solution, and then while the solution is heated and stirred at 40° C. to 100° C., the organic acid is added and dissolved by a neutralization reaction. After the organic acid is dissolved, the water-soluble polymer is added and is dissolved while being heated and stirred at 40° C. to 100° C. After the water-soluble polymer is dissolved, the resultant aqueous solution is cooled to room temperature, water-based resin particles are added and stirred to obtain a solution. Examples of the alkali metal salt include sodium hydroxide and potassium hydroxide.

In a case where an inorganic acid salt is used as the any other component, the inorganic acid salt can be, for example, in the foregoing example, added while being heated and stirred at 40° C. to 100° C. after the organic acid is dissolved and before the water-soluble polymer is added. Further, in a case where inorganic powder is used as the any other component, the inorganic powder can be, for example, in the foregoing example, added simultaneously with the water-based resin particles.

In a lubricant composition in accordance with an embodiment of the present invention, a preferable combination of contents of the respective components is not particularly limited, provided that a weight ratio of the (b) water-based resin particles to the (a) alkali metal salt of the organic acid, represented as a weight of the (b) water-based resin particles/a weight of the (a) alkali metal salt of the organic acid, is less than 10. For example, a preferable combination of the contents of the respective components is such that, relative to 100% by weight of the lubricant composition for plastic working, the content of the (a) alkali metal salt of the organic acid is 1% by weight to 35% by weight, the content of the (b) water-based resin particles is 0.1% by weight to 20% by weight, the content of the (c) water-soluble polymer is 0.01% by weight to 15% by weight, and the (d) water accounts for the remainder. More preferably, relative to 100% by weight of the lubricant composition for plastic working, the content of the (a) alkali metal salt of the organic acid is 3% by weight to 30% by weight, the content of the (b) water-based resin particles is 0.3% by weight to 15% by weight, the content of the (c) water-soluble polymer is 0.05% by weight to 10% by weight, and the (d) water accounts for the remainder. Even more preferably, relative to 100% by weight of the lubricant composition for plastic working, the content of the (a) alkali metal salt of the organic acid is 5% by weight to 25% by weight, the content of the (b) water-based resin particles is 0.5% by weight to 12% by weight, the content of the (c) water-soluble polymer is 0.1% by weight to 5% by weight, and the (d) water accounts for the remainder.

A lubricant composition in accordance with an embodiment of the present invention can be used as it is as a lubricant, or can be diluted with water or the like and used. A dilution ratio of a lubricant composition in accordance with an embodiment of the present invention may be adjusted as appropriate in accordance with components used, an amount applied onto a die, and the like.

Examples of a method for applying a lubricant composition in accordance with an embodiment of the present invention onto a die is not particularly limited, provided that the lubricant composition can be uniformly applied onto the surface of the die. Examples of the method include spraying. When a lubricant composition in accordance with an embodiment of the present invention is applied onto a surface of a die, heat of the die causes a solution component, such as water, to be evaporated, so that a lubricating film is formed.

Thus, the present invention includes the following arrangements.

[1] A lubricant composition for plastic working of a ferrous material, containing (a) an alkali metal salt of an organic acid, (b) water-based resin particles, (c) a water-soluble polymer, and (d) water, wherein a weight ratio of the (b) water-based resin particles to the (a) alkali metal salt of the organic acid, represented as a weight of the (b) water-based resin particles/a weight of the (a) alkali metal salt of the organic acid, is less than 10, and the (b) water-based resin particles include particles having a particle diameter of not more than 0.1 μm in an amount of more than 5% by weight relative to a total amount of the (b) water-based resin particles.

[2] The lubricant composition as set forth in [1], wherein the weight ratio of the (b) water-based resin particles to the (a) alkali metal salt of the organic acid, represented as the weight of the (b) water-based resin particles/the weight of the (a) alkali metal salt of the organic acid, is not less than 0.02.

[3] The lubricant composition as set forth in [1] or [2], wherein the water-based resin particles are particles of at least one selected from the group consisting of an acrylic resin, a styrene-acrylic resin, a vinyl acetate-acrylic resin, a urethane resin, a urethane-acrylic resin, a silicone-acrylic resin, a polyester resin, a silicone-urethane resin, and a polyolefin resin.

[4] The lubricant composition as set forth in any one of [1] through [3], wherein the (b) water-based resin particles include particles having a particle diameter of not more than 0.1 μm in an amount of more than 5% by weight relative to a total amount of the (b) water-based resin particles, and have an average particle diameter of 0.01 μm to 10 μm.

[5] The lubricant composition as set forth in any one of [1] through [4], further containing: at least one selected from (e) an inorganic acid salt and (f) inorganic powder.

EXAMPLES

The following description will more specifically discuss the present invention based on Examples; however, the present invention is not limited to the following Examples.

1. Preparation of Lubricant Composition

Example 1

NaOH was added to water to obtain a solution. Then, while the solution was heated and stirred at 40° C. to 100° C., an organic acid was added and dissolved by a neutralization reaction. After the organic acid was dissolved, an alkali metal salt of an inorganic acid was, as necessary, dissolved while being heated and stirred at 40° C. to 100° C. After the dissolution, a water-soluble polymer was added and was dissolved while being heated and stirred at 40° C. to 100° C. The resultant aqueous solution was cooled to not higher than 40° C. To the aqueous solution thus cooled, water-based resin particles (and inorganic powder, as necessary) were added and mixed while being stirred. Thus prepared were lubricant compositions for plastic working in accordance with Examples and Comparative Examples, each of the lubricant compositions containing components mixed in respective amounts indicated in Tables 1 to 3.

In Tables 1 to 3, an amount of each component mixed represents an amount of a solid content (unit: % by weight relative to a total weight of a lubricant composition for plastic working). Details of the components are indicated below.

<(a) Component: Alkali Metal Salt of Organic Acid>

As described above, NaOH was added to water to obtain a solution, and while the solution was heated and stirred at 40° C. to 100° C., an organic acid was added to cause a neutralization reaction to prepare an alkali metal salt of the organic acid.

(a-1) Disodium isophthalate: isophthalic acid manufactured by LOTTE CHEMICAL CORPORATION was neutralized.

(a-2) Disodium adipate: adipic acid manufactured by BASF Japan Ltd. was neutralized.

<(b) Component: Water-Based Resin Particles>

Used was a commercially available product containing: water serving as a medium; and a resin indicated below and dispersed in the form of a water-soluble type, a colloidal dispersion type, an emulsion type, or the like. Numerical values in Tables each represent an active ingredient of water-based resin particles in a lubricant composition.

(b-1) Acrylic resin: VONCOAT (registered trademark) CF8700, manufactured by DIC Corporation.

(b-2) Styrene-acrylic resin (1): Polysol (registered trademark) AP5695, manufactured by Showa Denko K.K.

(b-3) Styrene-acrylic resin (2): Polysol (registered trademark) AP2675PN, manufactured by Showa Denko K.K.

(b-4) Styrene-acrylic resin (3): VONCOAT (registered trademark) SK-105-E, manufactured by DIC Corporation.

(b-5) Styrene-acrylic resin (4): Polysol (registered trademark) AP1700N, manufactured by Showa Denko K.K.

(b-6) Styrene-acrylic resin (5): VONCOAT (registered trademark) EC905EF, manufactured by DIC Corporation.

(b-7) Styrene-acrylic resin (6): Polysol (registered trademark) AP1272, manufactured by Showa Denko K.K.

(b-8) Vinyl acetate-acrylic resin: VONCOAT (registered trademark) CF2800, manufactured by DIC Corporation.

(b-9) Silicone-acrylic resin: VONCOAT (registered trademark) SA6340, manufactured by DIC Corporation.

(b-10) Silicone-urethane resin: CHALINE (registered trademark) RU-911, manufactured by Nissin Chemical Industry Co., Ltd.

(b-11) Urethane-acrylic resin: VONCOAT (registered trademark) HY364, manufactured by DIC Corporation.

(b-12) Urethane resin: SUPERFLEX (registered trademark) 210, manufactured by Dai-ichi Kogyo Seiyaku Co., Ltd.

(b-13) Polyester resin: PLAS COAT (registered trademark) z-687, manufactured by GOO Chemical Co., Ltd.

(b-14) Polyethylene resin: HORDAMER PE03, manufactured by BYK JAPAN KK.

(b-15) Phenol resin: a commercially available white lubricant.

<(c) Component: Water-Soluble Polymer>

(c-1) Hydroxyethyl cellulose: DAICEL SP-500, manufactured by Daicel FineChem Ltd.

(c-2) Sodium salt of isobutylene maleic anhydride: isobutylene maleic anhydride manufactured by KURARAY CO., LTD. was neutralized.

<(d) Component: Water>

(d-1) Water: ion exchange water.

<Other Components>

(Inorganic Powder)

Silica: CARPLEX (registered trademark) #80, manufactured by EVONIK JAPAN CO., LTD.

Calcium carbonate: HAKUENKA (registered trademark) T-DD, manufactured by Shiraishi Calcium Kaisha, Ltd.

Melamine cyanurate: MC-6000, manufactured by Nissan Chemical Industries, Ltd.

Mica: Repco mica M-XF, manufactured by Repco, Inc.

Boron nitride: YINGKOU LIAOBIN METICULOUS CHEMICAL CO., LTD (Inorganic Acid Salt)

Sodium sulfate: Wako Pure Chemical Industries, Ltd.

Sodium borate: Wako Pure Chemical Industries, Ltd.

Sodium nitrate: Wako Pure Chemical Industries, Ltd.

Sodium carbonate: Wako Pure Chemical Industries, Ltd.

Disodium hydrogen phosphate: Wako Pure Chemical Industries, Ltd.

(Commercially Available Graphite-Based Lubricant)

Graphite-based: HITASOL (registered trademark) GA-651E, manufactured by Hitachi Chemical Co., Ltd.

TABLE 1

| Component | | Example 1 | Example 2 | Example 3 | Example 4 | Example 5 | Example 6 | Example 7 |
|---|---|---|---|---|---|---|---|---|
| (a) Alkali metal salt of organic acid | Disodium isophthalate | 23.5 | 23 | 22 | 22 | 22 | 22 | 22 |
| | Disodium adipate | | | | | | | |
| (b) Water-based resin particles | Acrylic resin | 0.5 | 1 | 2 | 2 | 2 | 2 | 2 |
| | Styrene-acrylic resin (1) | | | | | | | |
| | Styrene-acrylic resin (2) | | | | | | | |
| | Styrene-acrylic resin (3) | | | | | | | |
| | Styrene-acrylic resin (4) | | | | | | | |
| | Styrene-acrylic resin (5) | | | | | | | |
| | Styrene-acrylic resin (6) | | | | | | | |
| | Vinyl acetate-acrylic resin | | | | | | | |
| | Silicone-acrylic resin | | | | | | | |
| | Silicone-urethane resin | | | | | | | |
| | Urethane-acrylic resin | | | | | | | |
| | Urethane resin | | | | | | | |
| | Polyester resin | | | | | | | |
| | Polyethylene resin | | | | | | | |
| | Phenol resin | | | | | | | |
| (c) Water-soluble polymer | Hydroxyethyl cellulose | 0.4 | 0.4 | 0.4 | 0.4 | 0.4 | 0.4 | 0.4 |
| | Sodium salt of isobutylene maleic anhydride | | | | | | | |
| Inorganic powder | Calcium carbonate | | | | | | 1 | |
| | Melamine | | | | | | | 1 |

TABLE 1-continued

| | | | | | | | | |
|---|---|---|---|---|---|---|---|---|
| | cyanurate | | | | | | | |
| | Silica | 1 | 1 | | | | | |
| | Mica | | | | | | | |
| | Boron nitride | | | | | | | |
| Inorganic acid salt | Sodium sulfate | | | | | | | |
| | Sodium borate | | | | | | | |
| | Sodium nitrate | | | | | | | |
| | Sodium carbonate | 2 | 2 | | | 2 | 2 | 2 |
| | Disodium hydrogen phosphate | 3 | 3 | | 3 | 3 | 3 | 3 |
| Commercially available graphite-based lubricant | Graphite-based | | | | | | | |
| (d) Water | Water | Remainder | Remainder | Remainder | Remainder | Remainder | Remainder | Remainder |
| Evaluation condition | Dilution ratio | 10 | 10 | 10 | 10 | 10 | 10 | 10 |
| Ring compression test | Friction coefficient | 0.172 | 0.156 | 0.156 | 0.155 | 0.149 | 0.146 | 0.144 |

| Component | | Example 8 | Example 9 | Example 10 | Example 11 | Example 12 | Example 13 | Example 14 |
|---|---|---|---|---|---|---|---|---|
| (a) Alkali metal salt of organic acid | Disodium isophthalate | 22 | 22 | 22 | 22 | 22 | 22 | 11.0 |
| | Disodium adipate | | | | | | | |
| (b) Water-based resin particles | Acrylic resin | 2 | 2 | 2 | 2 | 2 | 2 | 1.2 |
| | Styrene-acrylic resin (1) | | | | | | | |
| | Styrene-acrylic resin (2) | | | | | | | |
| | Styrene-acrylic resin (3) | | | | | | | |
| | Styrene-acrylic resin (4) | | | | | | | |
| | Styrene-acrylic resin (5) | | | | | | | |
| | Styrene-acrylic resin (6) | | | | | | | |
| | Vinyl acetate-acrylic resin | | | | | | | |
| | Silicone-acrylic resin | | | | | | | |
| | Silicone-urethane resin | | | | | | | |
| | Urethane-acrylic resin | | | | | | | |
| | Urethane resin | | | | | | | |
| | Polyester resin | | | | | | | |
| | Polyethylene resin | | | | | | | |
| | Phenol resin | | | | | | | |

TABLE 1-continued

| | | | | | | | | |
|---|---|---|---|---|---|---|---|---|
| (c) Water-soluble polymer | Hydroxyethyl cellulose | 0.4 | 0.4 | 0.4 | 0.4 | 0.4 | 0.4 | 0.2 |
| | Sodium salt of isobutylene maleic anhydride | | | | | | | |
| Inorganic powder | Calcium carbonate | | | | | | | |
| | Melamine cyanurate | | | | | | | |
| | Silica | 1 | | | | | | 0.5 |
| | Mica | | 1 | | | | | |
| | Boron nitride | | | 1 | 1 | 1 | 1 | |
| Inorganic acid salt | Sodium sulfate | | | | 2.5 | | | |
| | Sodium borate | | | | | 2.5 | | |
| | Sodium nitrate | | | | | | 2.5 | |
| | Sodium carbonate | 2 | 2 | 2 | | | | 1.0 |
| | Disodium hydrogen phosphate | 3 | 3 | 3 | | | | 1.5 |
| Commercially available graphite-based lubricant | Graphite-based | | | | | | | |
| (d) Water | Water | Remainder | Remainder | Remainder | Remainder | Remainder | Remainder | Remainder |
| Evaluation condition | Dilution ratio | 10 | 10 | 10 | 10 | 10 | 10 | 10 |
| Ring compression test | Friction coefficient | 0.145 | 0.144 | 0.143 | 0.146 | 0.147 | 0.148 | 0.155 |

| Component | | Example 15 | Example 16 | Example 17 | Example 18 | Example 19 | Example 20 | Example 21 |
|---|---|---|---|---|---|---|---|---|
| (a) Alkali metal salt of organic acid | Disodium isophthalate | 7.3 | 5.5 | 22 | 22 | 22 | 22 | 22 |
| | Disodium adipate | | | | | | | |
| (b) Water-based resin particles | Acrylic resin | 0.8 | 0.6 | | | | | |
| | Styrene-acrylic resin (1) | | | 2 | | | | |
| | Styrene-acrylic resin (2) | | | | 2 | | | |
| | Styrene-acrylic resin (3) | | | | | 2 | | |
| | Styrene-acrylic resin (4) | | | | | | 2 | |
| | Styrene-acrylic resin (5) | | | | | | | 2 |
| | Styrene-acrylic resin (6) | | | | | | | |
| | Vinyl acetate-acrylic resin | | | | | | | |
| | Silicone-acrylic resin | | | | | | | |
| | Silicone-urethane resin | | | | | | | |
| | Urethane-acrylic resin | | | | | | | |
| | Urethane resin | | | | | | | |

TABLE 1-continued

| | | | | | | | | |
|---|---|---|---|---|---|---|---|---|
| | Polyester resin | | | | | | | |
| | Polyethylene resin | | | | | | | |
| | Phenol resin | | | | | | | |
| (c) Water-soluble polymer | Hydroxyethyl cellulose | 0.1 | 0.10 | 0.4 | 0.4 | 0.4 | 0.4 | 0.4 |
| | Sodium salt of isobutylene maleic anhydride | | | | | | | |
| Inorganic powder | Calcium carbonate | | | | | | | |
| | Melamine cyanurate | | | | | | | |
| | Silica | 0.33 | 0.25 | 1 | 1 | 1 | 1 | 1 |
| | Mica | | | | | | | |
| | Boron nitride | | | | | | | |
| Inorganic acid salt | Sodium sulfate | | | | | | | |
| | Sodium borate | | | | | | | |
| | Sodium nitrate | | | | | | | |
| | Sodium carbonate | 0.67 | 0.50 | 2 | 2 | 2 | 2 | 2 |
| | Disodium hydrogen phosphate | 1.00 | 0.75 | 3 | 3 | 3 | 3 | 3 |
| Commercially available graphite-based lubricant | Graphite-based | | | | | | | |
| (d) Water | Water | Remainder | Remainder | Remainder | Remainder | Remainder | Remainder | Remainder |
| Evaluation condition | Dilution ratio | 10 | 10 | 10 | 10 | 10 | 10 | 10 |
| Ring compression test | Friction coefficient | 0.157 | 0.169 | 0.150 | 0.152 | 0.142 | 0.150 | 0.150 |

TABLE 2

| Component | | Example 22 | Example 23 | Example 24 | Example 25 | Example 26 | Example 27 | Example 28 |
|---|---|---|---|---|---|---|---|---|
| (a) Alkali metal salt of organic acid | Disodium isophthalate | 22 | 22 | 22 | 22 | 22 | 22 | 22 |
| | Disodium adipate | | | | | | | |
| (b) Water-based resin particles | Acrylic resin | | | | | | | |
| | Styrene-acrylic resin (1) | | | | | | | |
| | Styrene-acrylic resin (2) | | | | | | | |
| | Styrene-acrylic resin (3) | | | | | | | |
| | Styrene-acrylic resin (4) | | | | | | | |
| | Styrene-acrylic resin (5) | | | | | | | |
| | Styrene-acrylic resin (6) | 2 | | | | | | |
| | Vinyl acetate-acrylic resin | | 2 | | | | | |

TABLE 2-continued

| | | | | | | | | |
|---|---|---|---|---|---|---|---|---|
| | Silicone-acrylic resin | | | 2 | | | | |
| | Silicone-urethane resin | | | | 2 | | | |
| | Urethane-acrylic resin | | | | | 2 | | |
| | Urethane resin | | | | | | 2 | |
| | Polyester resin | | | | | | | 2 |
| | Polyethylene resin | | | | | | | |
| | Phenol resin | | | | | | | |
| (c) Water-soluble polymer | Hydroxyethyl cellulose | 0.4 | 0.4 | 0.4 | 0.4 | 0.4 | 0.4 | 0.4 |
| | Sodium salt of isobutylene maleic anhydride | | | | | | | |
| Inorganic powder | Silica | 1 | 1 | 1 | 1 | 1 | 1 | 1 |
| Inorganic acid salt | Sodium carbonate | 2 | 2 | 2 | 2 | 2 | 2 | 2 |
| | Disodium hydrogen phosphate | 3 | 3 | 3 | 3 | 3 | 3 | 3 |
| Commercially available graphite-based lubricant | Graphite-based | | | | | | | |
| (d) Water | Water | Remainder | Remainder | Remainder | Remainder | Remainder | Remainder | Remainder |
| Evaluation condition | Dilution ratio | 10 | 10 | 10 | 10 | 10 | 10 | 10 |
| Ring compression test | Friction coefficient | 0.144 | 0.170 | 0.159 | 0.172 | 0.154 | 0.161 | 0.158 |

| Component | | Example 29 | Example 30 | Example 31 | Example 32 | Example 33 | Example 34 | Example 35 |
|---|---|---|---|---|---|---|---|---|
| (a) Alkali metal salt of organic acid | Disodium isophthalate | 22 | 18 | 18 | 16 | 14 | 12 | 18 |
| | Disodium adipate | | | | | | | 4.7 |
| (b) Water-based resin particles | Acrylic resin | | 2 | 6 | 8 | 10 | 12 | 2 |
| | Styrene-acrylic resin (1) | | | | | | | |
| | Styrene-acrylic resin (2) | | | | | | | |
| | Styrene-acrylic resin (3) | | | | | | | |
| | Styrene-acrylic resin (4) | | | | | | | |
| | Styrene-acrylic resin (5) | | | | | | | |
| | Styrene-acrylic resin (6) | | | | | | | |
| | Vinyl acetate-acrylic resin | | | | | | | |
| | Silicone-acrylic resin | | | | | | | |
| | Silicone-urethane resin | | | | | | | |

TABLE 2-continued

| | | | | | | | | |
|---|---|---|---|---|---|---|---|---|
| | Urethane-acrylic resin | | | | | | | |
| | Urethane resin | | | | | | | |
| | Polyester resin | | | | | | | |
| | Polyethylene resin | 2 | | | | | | |
| | Phenol resin | | | | | | | |
| (c) Water-soluble polymer | Hydroxyethyl cellulose | 0.4 | 0.4 | 0.4 | 0.4 | 0.4 | 0.4 | |
| | Sodium salt of isobutylene maleic anhydride | | | | | | | 4.3 |
| Inorganic powder | Silica | 1 | 1 | 1 | 1 | 1 | 1 | |
| Inorganic acid salt | Sodium carbonate | 2 | 2 | 2 | 2 | 2 | 2 | |
| | Disodium hydrogen phosphate | 3 | 3 | 3 | 3 | 3 | 3 | |
| Commercially available graphite-based lubricant | Graphite-based | | | | | | | |
| (d) Water | Water | Remain-der | Remain-der | Remain-der | Remain-der | Remain-der | Remain-der | Remain-der |
| Evaluation condition | Dilution ratio | 10 | 10 | 10 | 10 | 10 | 10 | 10 |
| Ring compression test | Friction coefficient | 0.160 | 0.144 | 0.150 | 0.160 | 0.161 | 0.171 | 0.169 |

TABLE 3

| Component | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| (a) Alkali metal salt of organic acid | Disodium isophthalate | | 11 | 24 | 2 | 1 | 0.5 | | 22 |
| | Disodium adipate | | 10 | | | | | | |
| (b) Water-based resin particles | Acrylic resin | | | | 22 | 23 | 23.5 | 24 | 2 |
| | Styrene-acrylic resin (1) | | | | | | | | |
| | Styrene-acrylic resin (2) | | | | | | | | |
| | Styrene-acrylic resin (3) | | | | | | | | |
| | Styrene-acrylic resin (4) | | | | | | | | |
| | Styrene-acrylic resin (5) | | | | | | | | |
| | Styrene-acrylic resin (6) | | | | | | | | |
| | Vinyl acetate-acrylic resin | | | | | | | | |
| | Silicone-acrylic resin | | | | | | | | |
| | Silicone-urethane resin | | | | | | | | |
| | Urethane- | | | | | | | | |

TABLE 3-continued

| Component | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| | acrylic resin | | | | | | | | |
| | Urethane resin | | | | | | | | |
| | Polyester resin | | | | | | | | |
| | Polyethylene resin | | | | | | | | |
| | Phenol resin | | 3.5 | | | | | | |
| (c) Water-soluble polymer | Hydroxyethyl cellulose | | 3.4 | 0.4 | 0.4 | 0.4 | 0.4 | 0.4 | |
| | Sodium salt of isobutylene maleic anhydride | | | | | | | | |
| Inorganic powder | Silica | | | | 1 | 1 | 1 | 1 | 1 |
| Inorganic acid salt | Sodium carbonate | | | 2 | 2 | 2 | 2 | 2 | 2 |
| | Disodium hydrogen phosphate | | | 3 | 3 | 3 | 3 | 3 | 3 |
| Commercially available graphite-based lubricant | Graphite-based | 29 | | | | | | | |
| (d) Water | Water | Remainder | Remainder | Remainder | Remainder | Remainder | Remainder | Remainder | Remainder |
| Evaluation condition | Dilution ratio | 10 | 10 | 10 | 10 | 10 | 10 | 10 | 10 |
| Ring compression test | Friction coefficient | 0.172 | 0.179 | 0.189 | 0.191 | 0.189 | 0.193 | 0.197 | 0.225 |

Table 4 shows results obtained by measuring, with use of a laser diffraction/scatter particle size distribution meter LA-960V2 (manufactured by HORIBA, Ltd.), average particle diameters (median sizes) and percentage values of cumulative frequency of the (b) water-based resin particles used in Examples and Comparative Examples. The results of the measurement were obtained, with respect to particles of each water-based resin, by calculation on the basis of a refractive index of a resin shown under the item "Type" in Table 4.

TABLE 4

| Type | Median size (μm) | Percentage value of cumulative frequency (%) | | | | | | | |
|---|---|---|---|---|---|---|---|---|---|
| | | 0-0.05 | ≤0.1 | ≤0.2 | ≤0.3 | ≤0.5 | ≤1.0 | ≤10 | ≤20 |
| Acrylic resin | 0.09065 | 1.287 | 63.074 | 99.817 | 100 | 100 | 100 | 100 | 100 |
| Styrene-acrylic resin (1) | 0.20466 | 0.000 | 5.861 | 47.558 | 86.691 | 99.954 | 100 | 100 | 100 |
| Styrene-acrylic resin (2) | 0.08955 | 1.346 | 64.636 | 99.834 | 100 | 100 | 100 | 100 | 100 |
| Styrene-acrylic resin (3) | 0.09615 | 1.078 | 55.093 | 99.637 | 100 | 100 | 100 | 100 | 100 |
| Styrene-acrylic resin (4) | 0.08914 | 1.357 | 65.285 | 99.847 | 100 | 100 | 100 | 100 | 100 |
| Styrene-acrylic resin (5) | 0.08464 | 1.604 | 72.926 | 100 | 100 | 100 | 100 | 100 | 100 |
| Styrene-acrylic resin (6) | 0.09524 | 1.115 | 56.351 | 99.662 | 100 | 100 | 100 | 100 | 100 |
| Vinyl acetate-acrylic resin | 0.28094 | 0.000 | 5.583 | 29.655 | 54.07 | 75.999 | 81.258 | 96.333 | 99.646 |

TABLE 4-continued

| Type | Median size (μm) | Percentage value of cumulative frequency (%) 0-0.05 | ≤0.1 | ≤0.2 | ≤0.3 | ≤0.5 | ≤1.0 | ≤10 | ≤20 |
|---|---|---|---|---|---|---|---|---|---|
| Silicone-acrylic resin | 0.09843 | 1.014 | 51.996 | 99.397 | 100 | 100 | 100 | 100 | 100 |
| Silicone-urethane resin | 0.17002 | 0.000 | 7.846 | 68.807 | 96.676 | 100 | 100 | 100 | 100 |
| Urethane-acrylic resin | 0.08580 | 1.531 | 70.678 | 100 | 100 | 100 | 100 | 100 | 100 |
| Urethane resin | 0.08498 | 1.596 | 72.484 | 100 | 100 | 100 | 100 | 100 | 100 |
| Polyester resin | 0.07391 | 3.017 | 91.910 | 100 | 100 | 100 | 100 | 100 | 100 |
| Polyethylene resin | 0.12791 | 0.377 | 24.834 | 91.337 | 99.732 | 100 | 100 | 100 | 100 |
| Phenol resin | 8.99823 | 0 | 0 | 0 | 0 | 0 | 0 | 58.591 | 96.310 |

2. Evaluation Tests

<Ring Compression Test>

A ring compression test was conducted to measure a friction coefficient as an index of lubricity. The test was carried out under the following conditions.

The lubricant compositions for plastic working prepared in Examples 1 to 35 and Comparative Examples 1 to 8 were each diluted 10-fold with ion exchange water and then sprayed onto iron dies (an upper die and a lower die), which had been heated to 200° C., at a spray pressure of 0.3 MPa and a spray distance of 300 mm and in a spray amount of 4 cc. The dies thus sprayed were set to a 150-ton crank press (manufactured by Komatsu Industries Corp.).

Subsequently, an iron ring (material: S45C, φ30×φ15×10 mm) was heated to 1000° C. in an electric furnace and placed in between the upper die and the lower die for press forming. From a compression ratio of a test piece thus press formed and deformation in inner diameter of the test piece, a friction coefficient was calculated. The lower the friction coefficient, the better the lubricity in a direction perpendicular to the pressing direction. Results are shown in Tables 1 to 3.

<Dispersibility Test>

A dispersibility test was conducted to evaluate a degree of sedimentation of resin fine particles or powder in a diluted solution. The test was carried out under the following conditions.

The lubricant compositions for plastic working prepared in Examples 3, 4, 5, and 35 and Comparative Examples 1 to 3 were each diluted 10-fold with water in a sample tube, and then the sample tube was left to stand still for 24 hours. Then, observation was made as to presence or absence of sediment at the bottom of the sample tube, and evaluation was made in accordance with the following criteria. Results are shown in Table 5.

Good: No sediment was observed at all at the bottom of the sample tube which had been left to stand still for 24 hours.

Bad: Sediment was observed, at least in a small amount, at the bottom of the sample tube which had been left to stand still for 24 hours.

<Spike Test>

(Axial Elongation)

A spike test was conducted to evaluate axial elongation as an index of lubricity. The test was conducted under the following conditions.

The lubricant compositions for plastic working prepared in Examples 5 and 8 and Comparative Examples 1 and 2 were each diluted 50-fold with ion exchange water and then sprayed onto spike test dies, which had been heated to 150° C., at a spray pressure of 0.3 MPa and a spray distance of 300 mm and in a spray amount of 4 cc. The dies thus sprayed were set to a 150-ton crank press (manufactured by Komatsu Industries Corp.).

Subsequently, a test piece (material: S45C, φ25×30 mm) was heated to 1200° C. in an electric furnace and subjected to press forming. A height (axial elongation) of the test piece thus press formed was measured. Results are shown in Table 6.

(Seizure on (Sticking to) Dies)

When the test piece was formed as described above, the presence or absence of seizure between the test piece and the dies was evaluated in accordance with the following criteria. This evaluation allows evaluating whether or not the lubricant composition for plastic working is excellent in releasability. Results are shown in Table 6.

Good: The formed test piece was released from the die(s) without seizure between the test piece and the die(s).

Bad: The formed test piece was not released from the die(s) due to seizure between the test piece and the die(s).

TABLE 5

| Component | | Example 3 | Example 4 | Example 5 | Example 35 | Comparative Example 1 | Comparative Example 2 | Comparative Example 3 |
|---|---|---|---|---|---|---|---|---|
| (a) Alkali metal salt of organic acid | Disodium isophthalate | 22 | 22 | 22 | 18 | | 11 | 24 |
| | Disodium adipate | | | | 4.7 | | 10 | |

TABLE 5-continued

| Component | | Example 3 | Example 4 | Example 5 | Example 35 | Comparative Example 1 | Comparative Example 2 | Comparative Example 3 |
|---|---|---|---|---|---|---|---|---|
| (b) Water-based resin particles | Acrylic resin | 2 | 2 | 2 | 2 | | | |
| | Phenol resin | | | | | | 3.5 | |
| (c) Water-soluble polymer | Hydroxyethyl cellulose | 0.4 | 0.4 | 0.4 | | | 3.4 | 0.4 |
| | Sodium salt of isobutylene maleic anhydride | | | | 4.3 | | | |
| Inorganic powder | Silica | | | | | | | |
| Inorganic acid salt | Sodium carbonate | | | 2 | | | | 2 |
| | Disodium hydrogen phosphate | | 3 | 3 | | | | 3 |
| Commercially available graphite-based lubricant | Graphite-based | | | | | 29 | | |
| (d) Water | Water | Remainder | Remainder | Remainder | Remainder | Remainder | Remainder | Remainder |
| Evaluation condition | Dilution ratio | 10 | 10 | 10 | 10 | 10 | 10 | 10 |
| Dispersibility | Presence/absence of sedimentation of resin or powder in diluted solution | Good | Good | Good | Good | Bad | Bad | Bad |
| Ring compression test | Friction coefficient | 0.156 | 0.155 | 0.149 | 0.169 | 0.172 | 0.179 | 0.189 |

TABLE 6

| Component | | Example 5 | Example 8 | Comparative Example 1 | Comparative Example 2 |
|---|---|---|---|---|---|
| (a) Alkali metal salt of organic acid | Disodium isophthalate | 22 | 22 | | 11 |
| | Disodium adipate | | | | 10 |
| (b) Water-based resin particles | Acrylic resin | 2 | 2 | | |
| | Phenol resin | | | | 3.5 |
| (c) Water-soluble polymer | Hydroxyethyl cellulose | 0.4 | 0.4 | | 3.4 |
| Inorganic powder | Silica | | 1 | | |
| Inorganic acid salt | Sodium carbonate | 2 | 2 | | |
| | Disodium hydrogen phosphate | 3 | 3 | | |
| Commercially available graphite-based lubricant | Graphite-based | | | 29 | |
| (d) Water | Water | Remainder | Remainder | Remainder | Remainder |
| Evaluation condition | Dilution ratio | 50 | 50 | 50 | 50 |
| Spike test | Axial elongation (mm) | 17.52 | 18.02 | 16.73 | 17.28 |
| | Sticking | Good (absent) | Good (absent) | Good (absent) | Bad (present) |

The evaluation results of Examples 1 to 35 shown in Tables 1 and 2 indicate that excellent lubricity comparable to lubricity exhibited in a case where the graphite-based lubricant of Comparative Example 1 is used is exhibited by a lubricant composition for plastic working which contains (a) an alkali metal salt of an organic acid, (b) water-based resin particles including particles having a particle diameter of not more than 0.1 μm in an amount of more than 5% by weight relative to a total amount of the water-based resin particles, (c) a water-soluble polymer, and (d) water and in which a weight ratio of the (b) water-based resin particles to the (a) alkali metal salt of the organic acid, represented as a weight of the (b) water-based resin particles/a weight of the (a) alkali metal salt of the organic acid, is less than 10.

In contrast, inferior lubricity is exhibited by a lubricant composition for plastic working in accordance with Comparative Example 2, in which a phenol resin including no particles having a particle diameter of not more than 0.1 μm is used as water-based resin particles in place of the water-based resin particles including particles having a particle diameter of not more than 0.1 μm in an amount of more than 5% by weight relative to a total amount of the water-based resin particles.

Further, the results of Comparative Examples 3, 7, and 8 indicate that inferior lubricity is exhibited by a lubricant composition for plastic working which lacks at least one selected from the group consisting of (a) an alkali metal salt of an organic acid, (b) water-based resin particles including particles having a particle diameter of not more than 0.1 μm in an amount of more than 5% by weight relative to a total amount of the water-based resin particles, and (c) a water-soluble polymer.

Further, the results of Examples 1, 2, 8, and 30 to 34 and Comparative Examples 4 to 6 indicate that the lubricant compositions for plastic working in accordance with Comparative Examples 4 to 6, in each of which a weight of (b) water-based resin particles/a weight of (a) alkali metal salt of an organic acid is not less than 10, are inferior in lubricity to the lubricant compositions for plastic working in accordance with Examples 1, 2, 8, and 30 to 34, in each of which a weight of (b) water-based resin particles/a weight of (a) alkali metal salt of an organic acid is less than 10.

The evaluation results of Examples 3, 4, 5, and 35 shown in Table 5 indicate that excellent dispersibility is exhibited by a lubricant composition for plastic working which contains (a) an alkali metal salt of an organic acid, (b) water-based resin particles including particles having a particle diameter of not more than 0.1 μm in an amount of more than 5% by weight relative to a total amount of the water-based resin particles, (c) a water-soluble polymer, and (d) water and in which a weight ratio of the (b) water-based resin particles to the (a) alkali metal salt of the organic acid, represented as a weight of the (b) water-based resin particles/a weight of the (a) alkali metal salt of the organic acid, is less than 10. In contrast, the evaluation results of Comparative Examples 1 to 3 indicate that the graphite-based lubricant in accordance with Comparative Example 1, the lubricant composition for plastic working in accordance with Comparative Example 2, in which a phenol resin including no particles having a particle diameter of not more than 0.1 μm is used, and the lubricant composition for plastic working in accordance with Comparative Example 3, which contains no water-based resin particles, are each inferior in dispersibility.

The evaluation results of Examples 5 and 8 shown in Table 6 indicate that excellent lubricity in an axial direction and excellent releasability are exhibited by a lubricant composition for plastic working which contains (a) an alkali metal salt of an organic acid, (b) water-based resin particles including particles having a particle diameter of not more than 0.1 μm in an amount of more than 5% by weight relative to a total amount of the water-based resin particles, (c) a water-soluble polymer, and (d) water and in which a weight ratio of the (b) water-based resin particles to the (a) alkali metal salt of the organic acid, represented as a weight of the (b) water-based resin particles/a weight of the (a) alkali metal salt of the organic acid, is less than 10. In contrast, the graphite-based lubricant in accordance with Comparative Example 1 is inferior in lubricity in an axial direction, and Comparative Example 2 for plastic working, in which a phenol resin including no particles having a particle diameter of not more than 0.1 μm is used, is inferior in releasability.

INDUSTRIAL APPLICABILITY

The present invention can be used as a lubricant in plastic working of a ferrous material carried out in a temperature range for warm working and a temperature range for hot working.

The invention claimed is:

1. A lubricant composition for plastic working of a ferrous material, comprising:

(a) an alkali metal salt of an organic acid;

(b) water-based resin particles;

(c) a water-soluble polymer; and (d) water, wherein a weight ratio of the (b) water-based resin particles to the (a) alkali metal salt of the organic acid, represented as a weight of the (b) water-based resin particles/a weight of the (a) alkali metal salt of the organic acid, is less than 10, the (b) water-based resin particles include particles having a particle diameter of not more than 0.1 μm in an amount of more than 5% by weight relative to a total amount of the (b) water-based resin particles, the (b) water-based resin particles have an average particle diameter of 0.01 μm to 0.3 μm, wherein the water-based resin particles are particles of at least one selected from the group consisting of an acrylic resin, a styrene-acrylic resin, a vinyl acetate-acrylic resin, a urethane resin, a urethane-acrylic resin, a silicone-acrylic resin, a silicone-urethane resin, and a polyolefin resin, and wherein the weight ratio of the (b) water-based resin particles to the (a) alkali metal salt of the organic acid, represented as the weight of the (b) water-based resin particles/the weight of the (a) alkali metal salt of the organic acid, is not less than 0.02.

2. The lubricant composition as set forth in claim 1, further comprising:

at least one selected from (e) an inorganic acid salt and (f) inorganic powder.

3. The lubricant composition as set forth in claim 1, wherein the (b) water-based resin particles include particles having a particle diameter of not less than 1.0 μm in an amount of not more than 5% by weight relative to a total amount of the (b) water-based resin particles.

4. A lubricant composition for plastic working of a ferrous material, comprising:

(a) an alkali metal salt of an organic acid;

(b) water-based resin particles;

(c) a water-soluble polymer; and (d) water, wherein a weight ratio of the (b) water-based resin particles to the (a) alkali metal salt of the organic acid, represented as a weight of the (b) water-based resin particles/a weight of the (a) alkali metal salt of the organic acid, is less than 10, the (b) water-based resin particles include particles having a particle diameter of not more than 0.1 μm in an amount of more than 5% by weight relative to a total amount of the (b) water-based resin particles, and the (b) water-based resin particles include particles having a particle diameter of not less than 1.0 μm in an amount of not more than 5% by weight relative to a total amount of the (b) water-based resin particles, wherein the water-based resin particles are particles of at least one selected from the group consisting of an acrylic resin, a styrene-acrylic resin, a vinyl acetate-acrylic resin, a urethane resin, a urethane-acrylic resin, a silicone-acrylic resin, a silicone-urethane resin, and a polyolefin resin, and wherein the weight ratio of the (b) water-based resin particles to the (a) alkali metal salt of the organic acid, represented as the weight of the (b) water-based resin particles/the weight of the (a) alkali metal salt of the organic acid, is not less than 0.02.

5. The lubricant composition as set forth in claim 4, wherein the (b) water-based resin particles have an average particle diameter of 0.01 μm to 10 μm.

6. The lubricant composition as set forth in claim 4, further comprising:

at least one selected from (e) an inorganic acid salt and (f) inorganic powder.

* * * * *